US007290431B1

(12) United States Patent
Spivak

(10) Patent No.: US 7,290,431 B1
(45) Date of Patent: Nov. 6, 2007

(54) RIVET SQUEEZER

(75) Inventor: Boris Spivak, Los Angeles, CA (US)

(73) Assignee: U.S. Industrial Tool & Supply Company, Gardena, CA (US)

( * ) Notice: Subject to any disclaimer, the term of this patent is extended or adjusted under 35 U.S.C. 154(b) by 0 days.

(21) Appl. No.: 11/622,905

(22) Filed: Jan. 12, 2007

(51) Int. Cl.
*B21J 15/34* (2006.01)
*B21D 39/00* (2006.01)

(52) U.S. Cl. ..... 72/452.8; 72/407; 72/416; 72/453.16; 29/243.53

(58) Field of Classification Search ..... 72/407, 72/413, 416, 452.8, 452.9, 453.07, 453.16; 29/237, 243.52, 243.53
See application file for complete search history.

(56) References Cited

U.S. PATENT DOCUMENTS

| | | | | |
|---|---|---|---|---|
| 2,011,877 | A | 8/1935 | Shaff | |
| 2,140,658 | A * | 12/1938 | Van Sittert | 72/452.8 |
| 2,350,002 | A | 5/1944 | Van Sittert et al. | |
| 2,396,562 | A | 3/1946 | Forss | |
| 2,647,814 | A | 8/1953 | Chilton | |
| 2,844,978 | A | 7/1958 | Wyland et al. | |
| 2,865,212 | A * | 12/1958 | Fischer et al. | 72/452.8 |
| 3,037,208 | A | 6/1962 | Haberstump | |
| 3,274,903 | A * | 9/1966 | Fischer et al. | 92/13.6 |
| 3,772,907 | A | 11/1973 | Rider | |
| 3,871,224 | A * | 3/1975 | Hilton | 72/407 |
| 3,877,280 | A * | 4/1975 | Cornell | 29/243.519 |
| 3,972,218 | A | 8/1976 | Pawloski | |
| 4,109,504 | A | 8/1978 | Rommel | |
| 4,226,109 | A | 10/1980 | Nilsson | |
| 4,571,975 | A * | 2/1986 | Pawloski et al. | 72/325 |
| 4,934,172 | A | 6/1990 | Bush et al. | |
| 5,040,278 | A | 8/1991 | Eckold et al. | |
| 5,309,751 | A | 5/1994 | Ryan | |
| 5,487,297 | A | 1/1996 | Ryan et al. | |
| 5,839,316 | A | 11/1998 | Kolivoski et al. | |
| 6,434,998 | B2 | 8/2002 | Amherd | |
| 7,000,448 | B2 | 2/2006 | Hamm et al. | |
| 7,155,955 | B2 * | 1/2007 | Bowles et al. | 72/453.16 |
| 7,219,526 | B2 * | 5/2007 | Herod | 72/453.07 |
| 2004/0010899 | A1 | 1/2004 | Winterhalter et al. | |

* cited by examiner

*Primary Examiner*—David B Jones
(74) *Attorney, Agent, or Firm*—Fulwider Patton LLP

(57) ABSTRACT

A pneumatically operated rivet squeezer is described, having features that allow for the miniaturization of a squeezer to a size smaller than portable rivet squeezers presently available. A first feature of the invention is that a return spring is accommodated within the squeezer housing by embedding the spring diametrically partially within a cavity in an internal wall of the housing and diametrically partially within a cavity in a jaw of the squeezer. A second feature of the invention contributing to miniaturization is that the squeezer utilizes a wedge having a very high mechanical advantage during the final stage of squeezing action, and a novel two curve surface for applying force to arms of the squeezer. A third feature of the invention contributing to miniaturization is that the squeezer utilizes a novel threading system for attachment of an air inlet piece to the squeezer housing, thereby eliminating the requirement for an O-ring to seal the attachment to the housing and achieving yet a further size reduction.

20 Claims, 7 Drawing Sheets

RIVET SQUEEZER

BACKGROUND OF THE INVENTION

The present invention relates to fluid operated tools in general, but more specifically to rivet squeezers operated by pneumatic power.

Pneumatic rivet squeezers are known in the art, and form an invaluable tool in the aircraft manufacturing industry. Opposing forces of some tons in magnitude can be made available to an artisan through a portable rivet squeezer. Such forces may be applied to the ends of rivets for joining structural elements together in a conventional way. The internal components of rivet squeezers have been developed over the years to provide efficiency, so that a degree of portability has been achieved in the manufacture of rivet squeezers. However, shortcoming still exist.

A basic portable rivet squeezer includes two pivoting jaws configured to provide a considerable opposing force to the external tips of the jaws. By forcing internal arms of the jaws apart, external tips of the jaws are forced together to provide the squeezing force. The force applied to open the internal arms of the jaws is typically applied by a reciprocating pneumatic ram, which is under considerable mechanical advantage through hydraulic leverage. At the tip of the pneumatic ram is a wedge which is inserted between the ends of the internal arms, forcing them apart under additional mechanical advantage. Once the squeezing force has been delivered to the rivet or other toolpiece, through the extension of the pneumatic ram, the ram is returned to its original position by a return spring system.

Although some degree of size reduction has taken place in the development of portable rivet squeezers, a current lightweight squeezer commonly may weigh around 1.7 kg. This size is an improvement on past technology, but it is still sufficiently large to present problems to artisans of small stature, such as women, who may find extended use of such a rivet squeezer to be difficult and tiring. Not only does the weight of such a device present a problem for artisans to manipulate the device with dexterity, but the size presents problems when the device is applied to smaller rivets, or rivets in awkward positions.

Thus, there is a present need for a lightweight miniaturized rivet squeezer that is capable of delivering the same squeezing force as current devices, while overcoming the shortcomings of size present in the prior art. The present invention addresses these and other needs.

SUMMARY OF THE INVENTION

According to a preferred embodiment of the invention, there is described a rivet squeezer that provides a sturdy and robust device for applying opposing forces of some tons to a rivet or other workpiece, where the rivet squeezer has the advantage of significant reduction in size, or miniaturization, over existing rivet squeezers commonly available.

In one aspect, the rivet squeezer of the present invention has a housing having a first cavity in an internal wall. A first jaw is positioned partially within the housing, the first jaw having a second cavity in an external wall. A second jaw is also positioned partially within the housing, and a wedge operable between a starting position and an ending position is provided. The wedge is adapted to be pneumatically forced from the starting position, thence between internal ends of the first and second jaws, to the ending position. In this way, the internal ends of the jaws are forced apart, and the external ends of the jaws are forced together. A return spring is provided for returning the wedge from the ending position to the starting position. The return spring is diametrically positioned partially within the first cavity in the housing, and partially within the second cavity in the first jaw. In this way, a space saving is achieved, and the diameter of the housing may be reduced in comparison with the diameter of rivet squeezers commonly available at present, in which the return spring is not accommodated, partially or at all, in a cavity in a wall of the jaw.

In a further aspect of the invention, the first jaw is, preferably, fixed to the housing, and the second jaw is pivotable about a pivot point. Further, the cavity in the first jaw is elongate and parallel to the direction of travel along which the wedge moves inside the housing of the squeezer. In this preferred aspect, the wedge is activated by a piston and the spring is positioned, at a first end of the spring, against the piston. Further, the spring may be positioned, at a second end of the spring, against a terminal point of the first cavity in the housing, and also against a terminal point of the second cavity in the first jaw.

In other aspects, a roller is pinned to the internal end of the first jaw for contacting the wedge as the wedge moves from starting to ending position. Further, a roller is pinned to the internal end of the second jaw for contacting the wedge as the wedge moves from starting to ending position.

A further feature of the invention is that the rivet squeezer may weigh less than 1 kilogram, and the length of the rivet squeezer may be less than 19 cm.

In another aspect of the invention which allows for a large force between the jaws of the rivet squeezer despite the fact that it enjoys a reduced size in comparison with presently commonly available rivet squeezers, the rivet squeezer may have a wedge that has a novel geometry capable of delivering large opposing forces despite overall miniaturization. Under this geometry, and using the terms defining the geometry of the wedge as they are defined below, the wedge may have:

- a first surface for engaging the first jaw, the first surface being flat; and
- a second surface for engaging the second jaw, the second surface including:
  - a first curve with a radius between 0.85 inches and 0.95 inches and a center point in a range between (−0.35 inches, 0.60 inches) and (−0.45 inches, 0.70 inches);
  - a second curve with a radius between 5.0 inches and 6.0 inches and a center point in a range between (−4.5 inches, 0.0 inches) and (−5.5 inches, 0.0 inches).

In another aspect, the wedge may have a height between 1.4 inches and 1.6 inches and a width between 0.5 inches and 0.6 inches;

In yet a further preferred aspect of the invention, the rivet squeezer may include a novel method of connecting an air supply to the housing of a rivet squeezer that eliminates the need for an O-ring to form an adequate air tight seal, and which accordingly provides for further miniaturization of the squeezer. In this aspect, the rivet squeezer includes a housing, a first jaw partially included within the housing and a second jaw partially included within the housing. A wedge operable between a starting position and an ending position is provided and adapted to be pneumatically forced from the starting position, thence between internal ends of the first and second jaws, to the ending position, whereby the internal ends are forced apart, and external ends of the jaws are forced together. An internal threaded bore in the housing for receiving an air supply is provided, the threaded bore having a thread gauge and being configured to have dimensions of a U.S. standard pipe thread with a conical taper. The threaded bore ends in a cylindrical bore having a first diameter. The cylindrical bore is configured to hold a valve. An air inlet piece for supplying air to the squeezer is provided, the inlet piece having external threads configured to mate with the threads of the tapered bore, the inlet piece having a terminal end with a second diameter not greater than the first diameter. The length of the valve is such that, when the inlet piece is inserted into the bore to a standard torque, the terminal end is a distance "t" from an end of the valve, "t" being between 0.8 and 1.2 times the gauge of the bore thread. Under these circumstances, the inlet piece is torqued into the bore beyond the standard torque such that the terminal end of the inlet piece is in contact with the end of the valve, and no O-ring is used to seal the inlet piece to the bore.

Thus, without the need for an O-ring to form an adequate air tight seal under standard shop air conditions (80-120 psi), the size of the rivet squeezer in the vicinity of the air connection may be reduced, and thus the size of the rivet squeezer may be further reduced overall, to permit advantageous miniaturization and ability to manipulate the rivet squeezer with dexterity while not substantially reducing the magnitude of the squeezing force under miniaturization.

These and other advantages of the invention will become more apparent from the following detailed description thereof and the accompanying exemplary drawings.

DETAILED DESCRIPTION OF THE PREFERRED EMBODIMENTS

Figure 1:
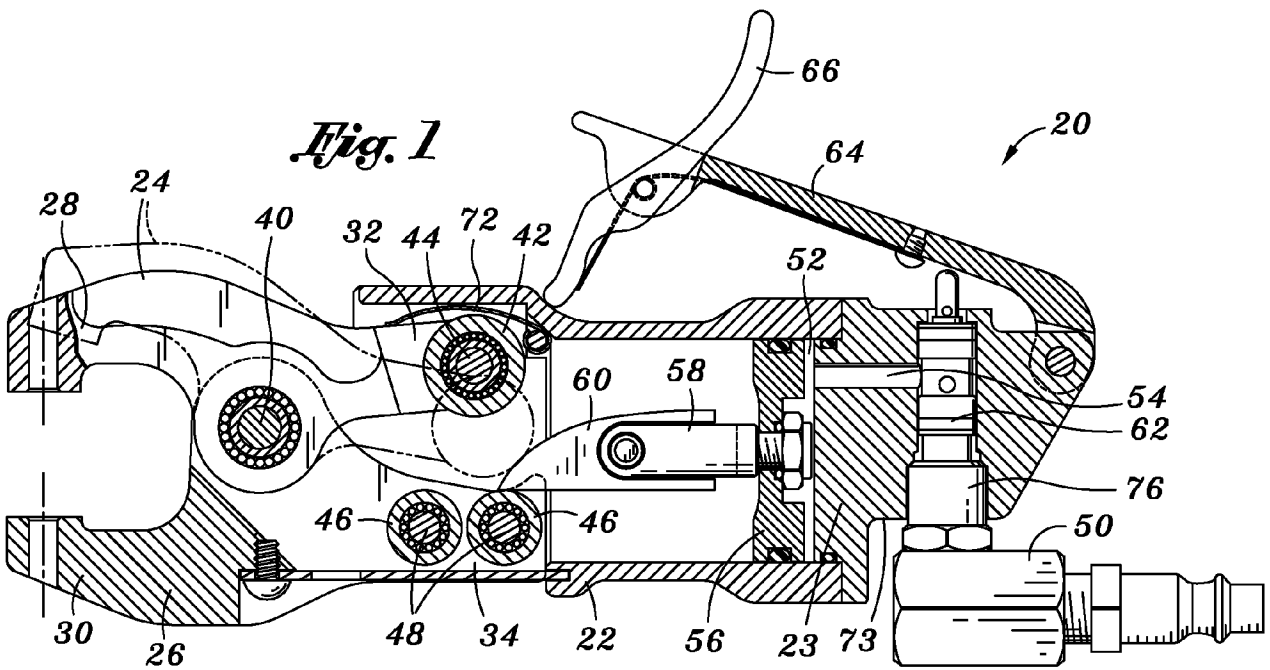
FIG. 1 is a side elevation partial sectional view of a rivet squeezer having features of the present invention.

With reference to the figures, which are provided for exemplification and not limitation, a portable rivet squeezer generally identified by the numeral 20 is described having features of the present invention. With initial reference to FIGS. 1-3, a generally cylindrical housing 22 is provided for encasing and protecting internal components. The housing includes an air connector element 23 to seal the proximal end of the housing and provides an inlet connection for compressed air. (The terms "proximal" and "distal" are made from the perspective of the user, with "proximal" meaning toward the user.) Two jaws are partially inserted within the distal end of the housing, an upper jaw 24 and a lower jaw 26. Each of the upper jaw 24 and lower jaw 26 has an external arm 28, 30 respectively and an internal arm 32, 34 respectively. The lower jaw 26 is configured to be immovably fixed to housing, while the upper jaw is free to pivot about a pin 40.

The external arms 28, 30 terminate in distal ends configured to receive a rivet for squeezing. The internal arms 32, 34 terminate in rollers pinned to the arms for facilitating the application of a separating force. Specifically, the upper internal arm 32 may have a roller 42 attached by a pin 44. The lower internal arm 34 has, in a preferred embodiment, two rollers 46 attached to the lower arm by pins 48.

At the proximal end of the rivet squeezer, an air supply 50 is provided, which gains access to an internal air chamber 52 by way of a channel 54 extending through the air connector element 23. A slidable piston 56 closes off the chamber 52 so that compressed air introduced to the chamber forces the piston 56 distally under mechanical advantage in a conventional way. A ram 58 is connected to the distal end of the piston 56 for attachment of a wedge 60 that has been specially configured, according to an aspect of the present invention, to provide a novel and advantageous force profile to the jaws when the wedge is forced between the rollers 42, 46, as set forth in greater detail below. It will be appreciated that distal movement of the wedge between the rollers 42, 46 will cause the external tips of the jaws to converge under considerable mechanical advantage. The access of air to the chamber 52 is controlled by means of a valve 62 operated by a safety (dead hand) lever 64 with a spring loaded activation element 66 positioned at the distal end of the lever.

Figure 2:
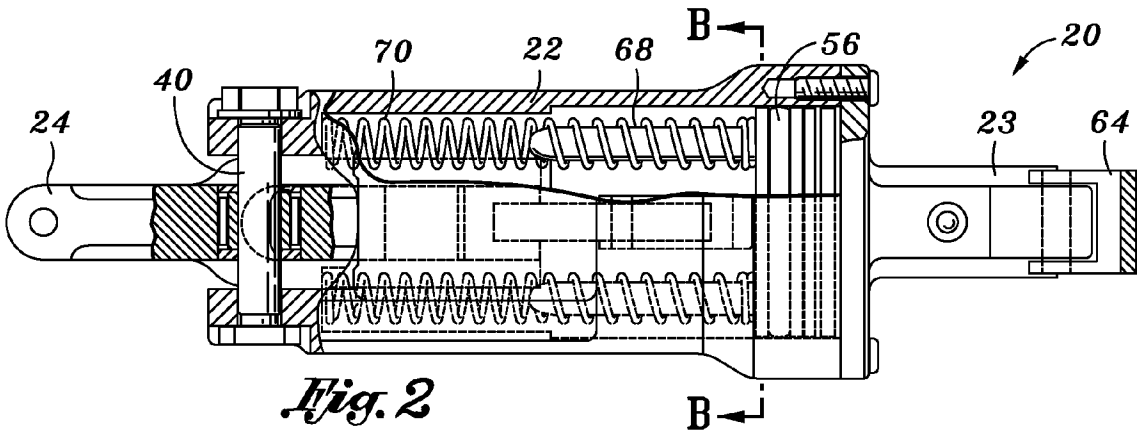
FIG. 2 is a top view of the rivet squeezer of FIG. 1, shown in partial breakaway.
Figure 3:
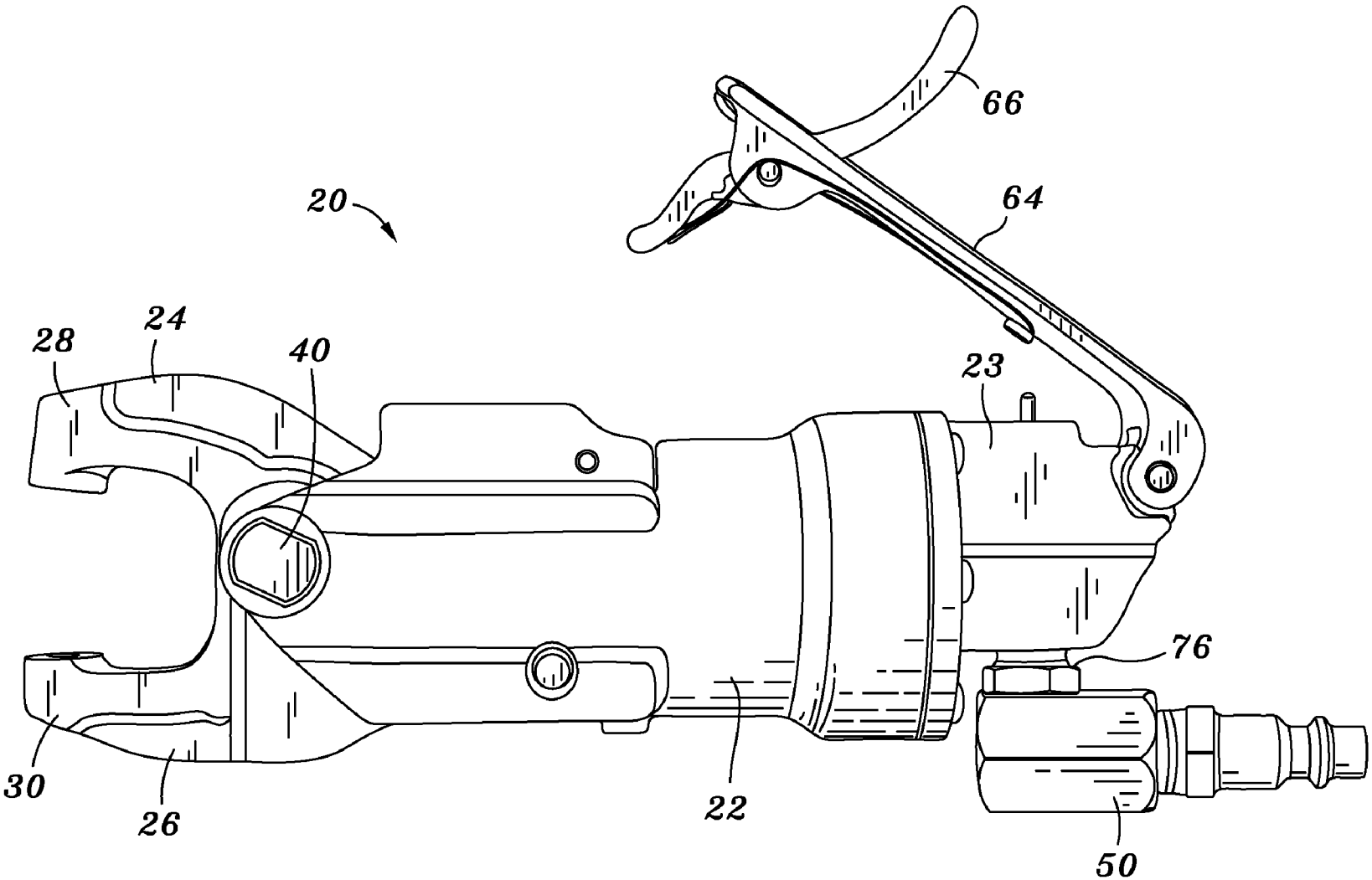
FIG. 3 is a perspective view of the squeezer of the above Figures.

Turning to FIG. 2, the piston 56 preferably has two elongate spindles 68 attached to the piston's distal surface, the spindles extending distally and flanking the lower jaw 26, each spindle being configured to receive a return spring 70 that extends distally beyond the tip of each spindle. It will be appreciated that, once the ram 58 has extended the wedge 60 distally to the maximum extent to open the jaws, there is no pneumatic force to return the piston 56 to its starting retracted position. However, in extending the wedge distally, the return springs 70 are compressed, so that they provide a force sufficient to overcome frictional and residual pressure forces to return the piston 56 to its starting retracted position, thus removing the wedge 60 from between the internal arms 32, 34 of the jaws. As the wedge 60 is thus removed, a restoring spring 72, which in a preferred embodiment is a leaf spring, is positioned to depress the internal arm of the upper jaw, thereby opening the external arms of the jaws and positioning the squeezer in a condition ready for the next compression operation. It has been found that, despite the miniaturization of the present rivet squeezer to a size smaller than those commonly presently available, a large retraction force is still required to withdraw the piston 56 after a compression operation due to the shape of the wedge provided by the present invention. Thus, the size of the return springs 70 may not be substantially reduced along with the other components of the squeezer comprising the present invention.

Figure 6:
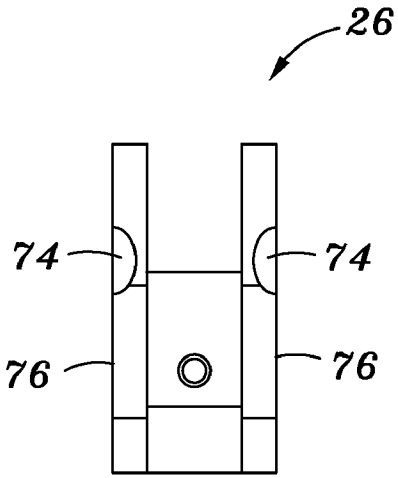
FIG. 6 is an end view of the jaw of FIG. 4.
Figure 5:
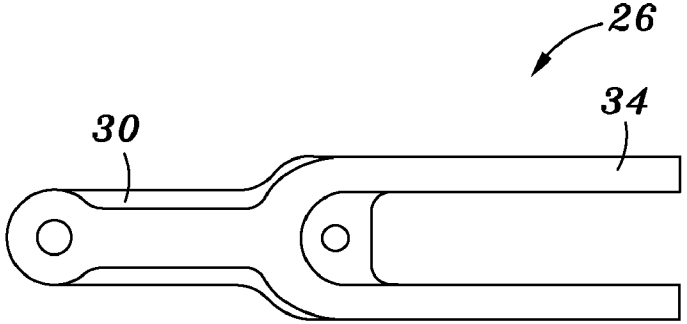
FIG. 5 is a top view of the jaw of FIG. 4.
Figure 4:
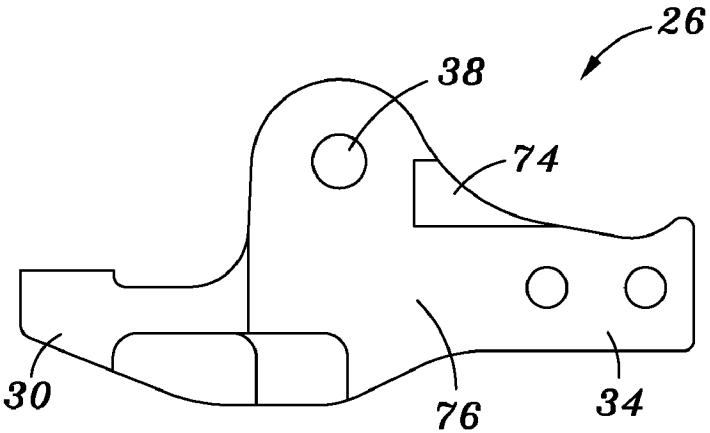
FIG. 4 is a side view of a jaw of the rivet squeezer of the above figures.
Figure 11:
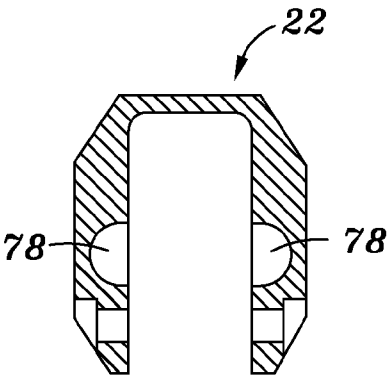
FIG. 11 is an end sectional view of the housing of the previous Figures, taken substantially through the line A-A in FIG. 10.
Figure 10:
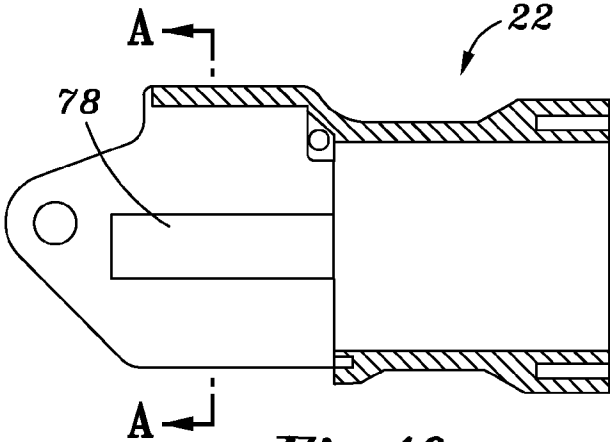
FIG. 10 is a side sectional view of the housing of FIG. 7.
Figure 9:
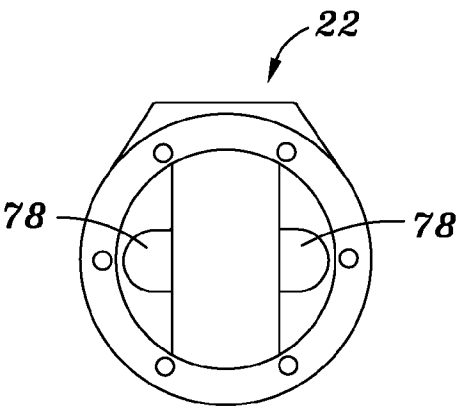
FIG. 9 is an end view of the housing of FIG. 7.
Figure 8:
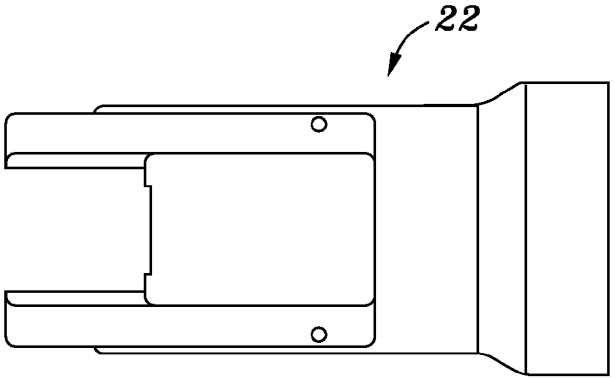
FIG. 8 is a top view of the housing of FIG. 7.
Figure 7:
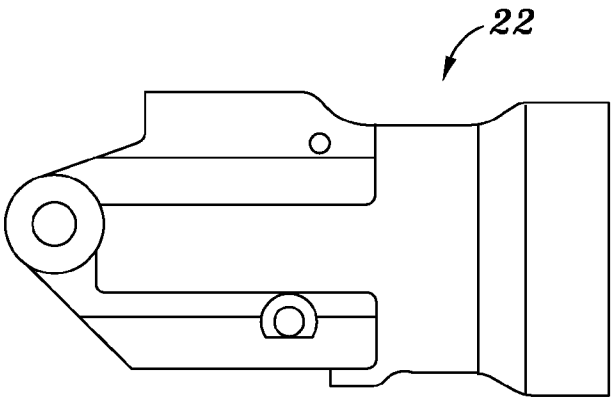
FIG. 7 is a side elevational view of a housing portion of the squeezer of FIG. 1.
Figure 12:
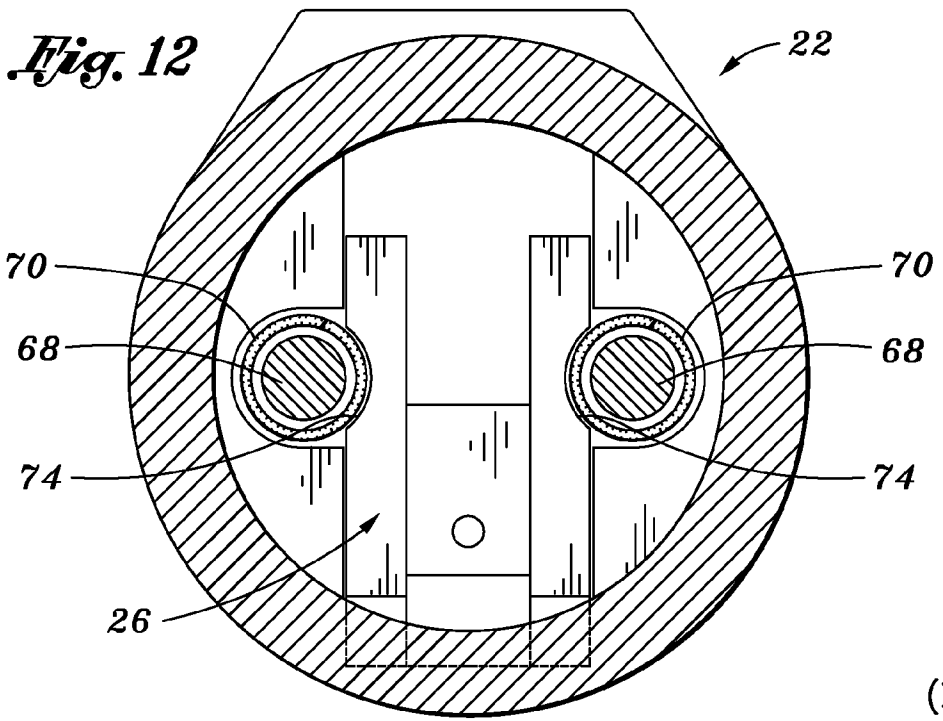
FIG. 12 is a partial sectional view through the squeezer of FIGS. 1-3, shown taken substantially along the line B-B in FIG. 2.

In order to enhance the miniaturization of the device of the present invention in view of the fact that the return spring 70 may not be substantially reduced in size compared to spring sizes of known devices, the following novel features of the squeezer are provided and found to be suitable to nevertheless allow for miniaturization and for the overall operation of the squeezer. While it is known in the art to insert a return spring within a cavity of the side wall of a housing to reduce the overall diameter of such housing, it has been found that an additional novel feature of a squeezer can suitably provide for further miniaturization. Specifically, a pair of jaw slots 74 (best seen in FIGS. 4, 6, and 12) may be machined or cast into opposite external lateral walls 76 of the lower jaw 26 to receive at least a diametrical portion of the springs 70 when the springs are mounted in the housing. Thus, as best seen in FIG. 12, while each spring 70 may be partially inserted, diametrically, within a cavity formed by a wall slot 78 (FIGS. 9-12), each spring 70 may also be partially inserted, diametrically, within a cavity in the lower jaw 26 by being partially positioned within one of the jaw slots 74. Thus, although the springs 70 may not be entirely embedded in the wall of the housing because the wall, under miniaturization of the squeezer, is too thin to accommodate the entire diameter of the spring 70, a space saving and reduction in diameter of the housing is achieved by inserting at least a diametrical portion of a spring 70 within a cavity 74 formed in the lower jaw 26.

Figure 13:
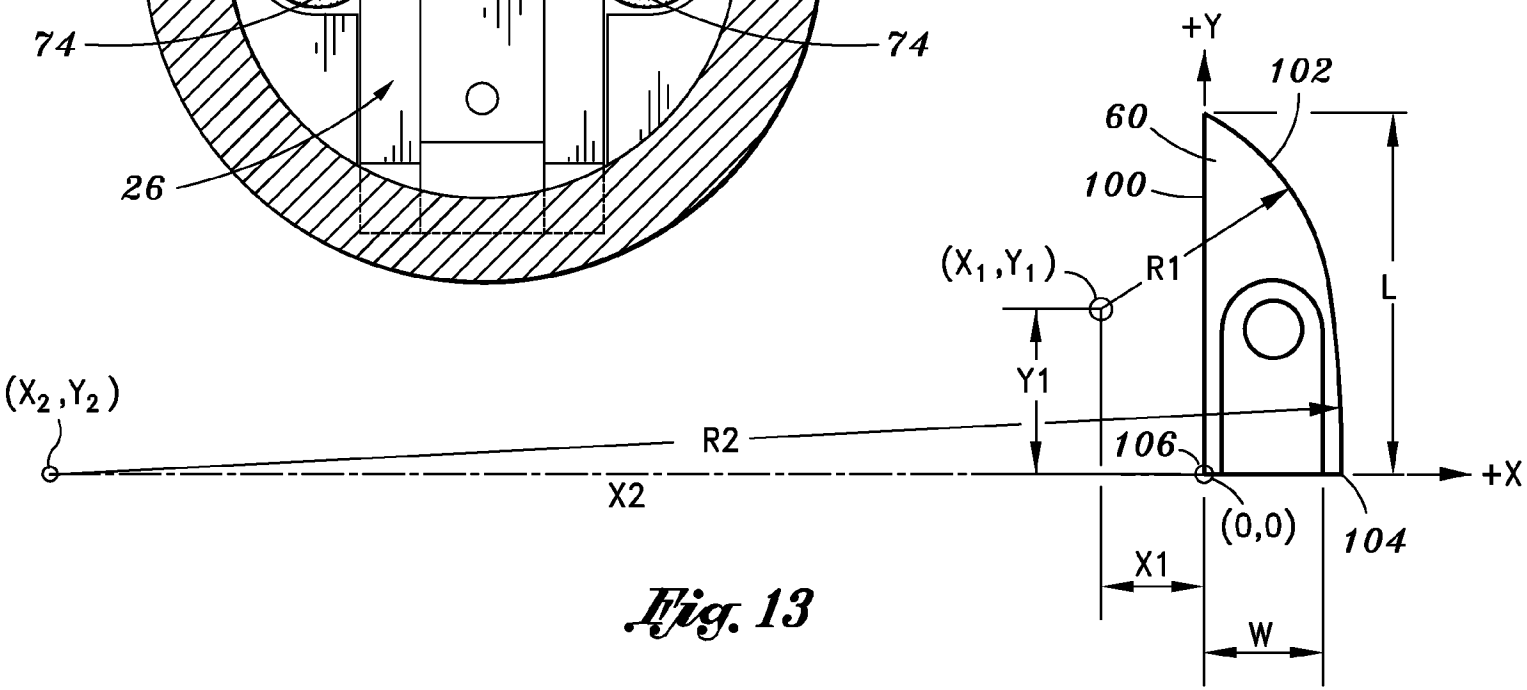
FIG. 13 is a side elevational view of a wedge having features of the present invention.

In a second aspect that facilitates and adds to the further miniaturization of the rivet squeezer of the present invention, the wedge 60 of the squeezer is shaped to enhance the maximum force extractable from the squeezer, to compare favorably with the maximum force presently produced by larger rivet squeezers. In this aspect, the wedge 60 is shaped according to the following geometry, which is also clarified with reference to FIG. 13. It will be appreciated that, because the lower jaw is fixed to the housing, the lower surface 100 of the wedge should be flat to provide a linear trajectory for the ram. One purpose behind the shape of the wedge of the present invention is to impart the maximum possible mechanical advantage to the two jaws when the ram reaches its furthest point of distal travel. In order to achieve this result, the slope of the upper surface 102 of the wedge (i.e. the rate at which the wedge tends to lift the arms apart divided by the rate at which the wedge moves distally) must tend toward zero at the upper proximal point 104 of the wedge. (The proximal point is taken as the most proximal point on the wedge which will still be in contact with the upper arm as the ram moves the wedge distally.) However, the wedge should not achieve this characteristic too soon (i.e. too distally remote from the proximal end) because, should the length of wedge that is close to having a zero slope be too long, the wedge becomes inefficient, providing a mechanical advantage that is too low in the early stages of its movement. It has been found that when the wedge has a shape defined as follows, for the degree of miniaturization achievable, an efficient transition between initial mechanical advantage and final advantage may be achieved. The terms defined here will be used consistently throughout. With reference to FIG. 13, a wedge of the present invention preferably has a length (L) between 1.4" and 1.6" and a width (W) between 0.5" and 0.6". The upper surface 102 of the wedge preferably includes two different radii of curvature, each having a different center point. Taking the lower proximal point 106 of the wedge (that is, the point orthogonally aligned with the "upper proximal point" 104) as the origin (0,0) of an orthogonal X, Y coordinate system in which the lower surface 100 of the wedge is the Y axis, the first center point (X1, Y1) may be located in a range between (−0.35", 0.60") and (−0.45", 0.70"), and may have a radius (R1) between 0.85" and 0.95" in length. The second center point (X2, Y2) may be located in a range between (−4.5", 0.0") and (−5.5", 0.0") and may have a radius (R2) between 5.0" and 6.0". As a limiting condition, the two curves join at a point that produces a continuous transition from one curve to the next, without any steps. It will be appreciated that, according to the above geometry, the slope of the upper surface of the wedge, at its most proximal point 104 in contact with the upper arm, is zero.

Figure 14:
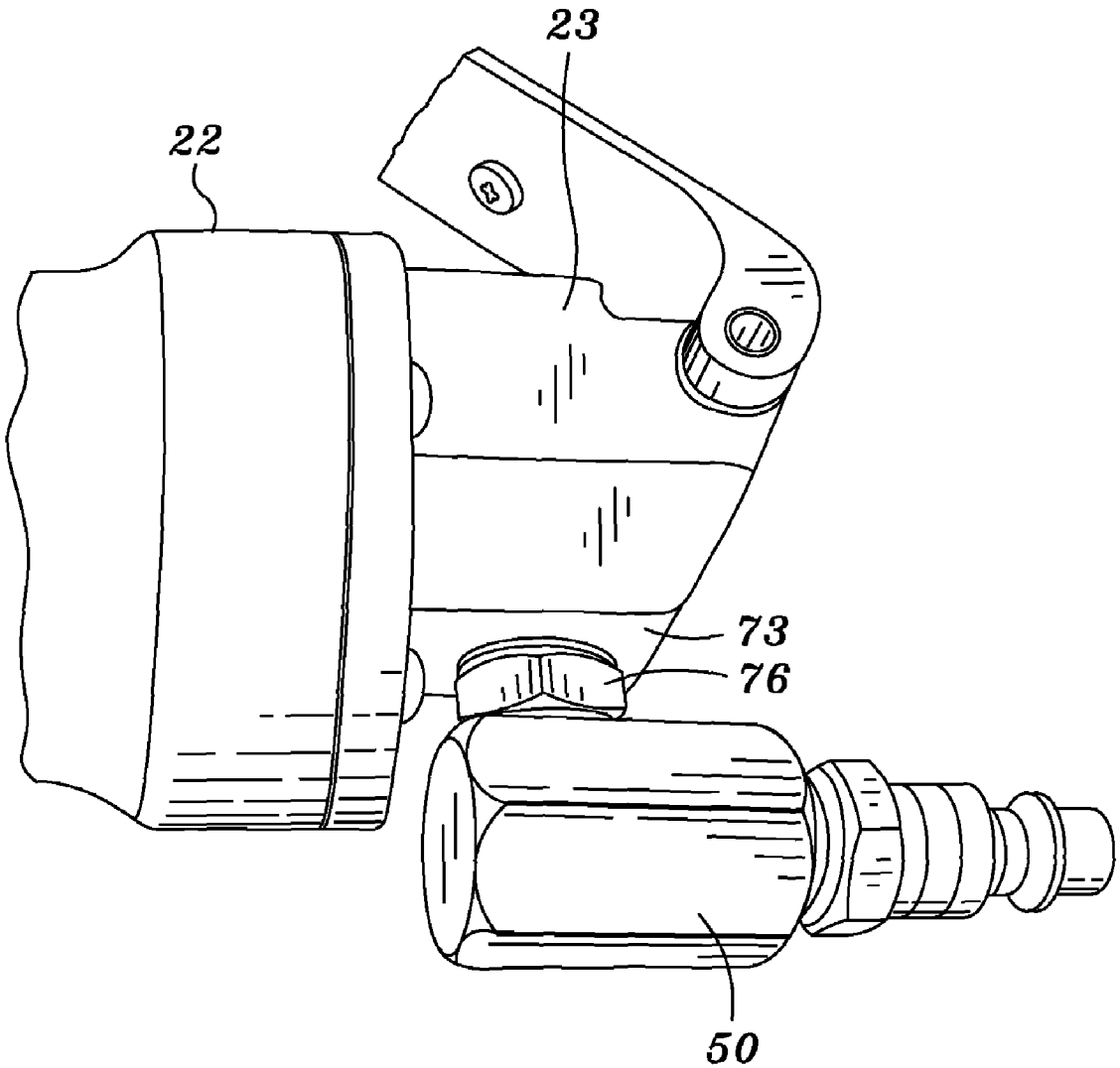
FIG. 14 is a perspective view of a portion of the squeezer of FIGS. 1-3.

In yet a further aspect that facilitates the miniaturization of the rivet squeezer of the present invention, it has been determined that certain structural features described below, in addition to those described above, further provide an advantage for reducing the overall size of a rivet squeezer. It is known in the prior art to introduce air into a chamber by way of a threaded air supply inlet that is screwed into a bore of a housing and sealed against air leakage by capturing an O-ring for compression against both the housing and the air supply inlet. However, by providing an O-ring, it is required that the housing be sufficiently wide in the area local to the connection to accommodate the O-ring. An aspect of the present invention is that, by selecting a novel configuration of threading to connect the air inlet piece 76 to the air connector element 23 of the housing, this configuration eliminates the need for an O-ring to form a seal, and allows for further miniaturization (and cost reduction) of components of the squeezer 20. When incorporating these features, described in more detail below with reference to FIGS. 14-16, the lower horizontal plate 73 of the air connector element 23 is just wide enough to accommodate the air inlet 76, yet without loss of structural integrity.

By adopting the following structural features, it has been determined that no O-ring need be provided to achieve an adequate seal between the air inlet 76 and the air connector element 23 of the housing. Under design conditions commonly used for attaching an air inlet to a housing, the external threads of an inlet, and the internal threads of a housing, are both standard cylindrical threads, used in combination with an O-ring. Ordinarily, the inlet is screwed into a bore in the housing until it is arrested by a shoulder on the inlet or on the housing. The standard cylindrical threads provide retention of the inlet in the housing, and the O-ring provides a seal. However, with the advantage that the elimination of the O-ring provides for miniaturization, another means for providing both retention of the inlet in the housing and a seal between inlet and housing is provided by the present invention. It has been found that where a threaded system in which the external threads of the inlet, on the one hand, and the internal threads of the housing, on the other, each have a U.S. standard pipe thread geometry, this configuration will provide an adequate seal and adequate retention simultaneously—under the further condition that the mating threads are configured to permit the inlet piece to be tightened about one revolution beyond the standard torque for a standard pipe threaded connection. A standard pipe thread is not cylindrical but slightly conical, or tapered. In the ordinary course if a standard pipe thread is used, and a corresponding standard torque is applied, retention is not adequately assured because a slight outward rotation of the inlet would tend to release the inlet from the housing due to the conical configuration of the threads. Despite this, the present invention provides a novel modification on a pipe thread connection configuration that provides both adequate retention and seal.

Figure 16:
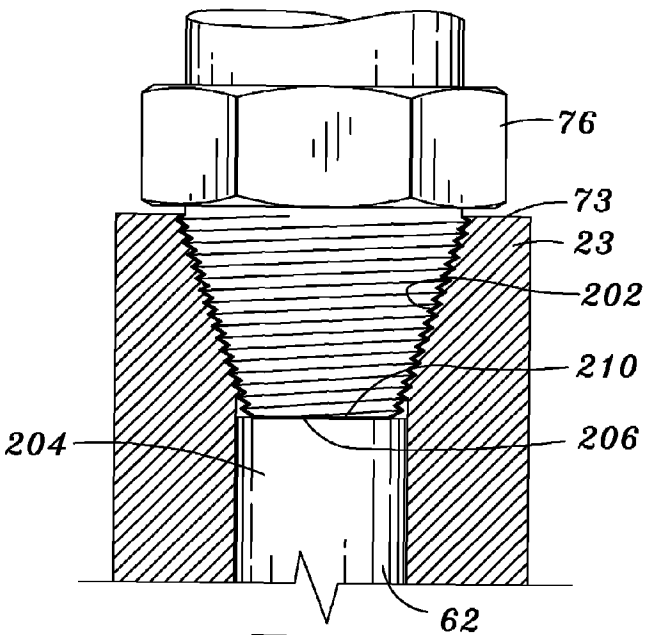
FIG. 16 is a schematic view of the internal bore of FIG. 15, joined with an air inlet piece according an aspect of the present invention.
Figure 15:
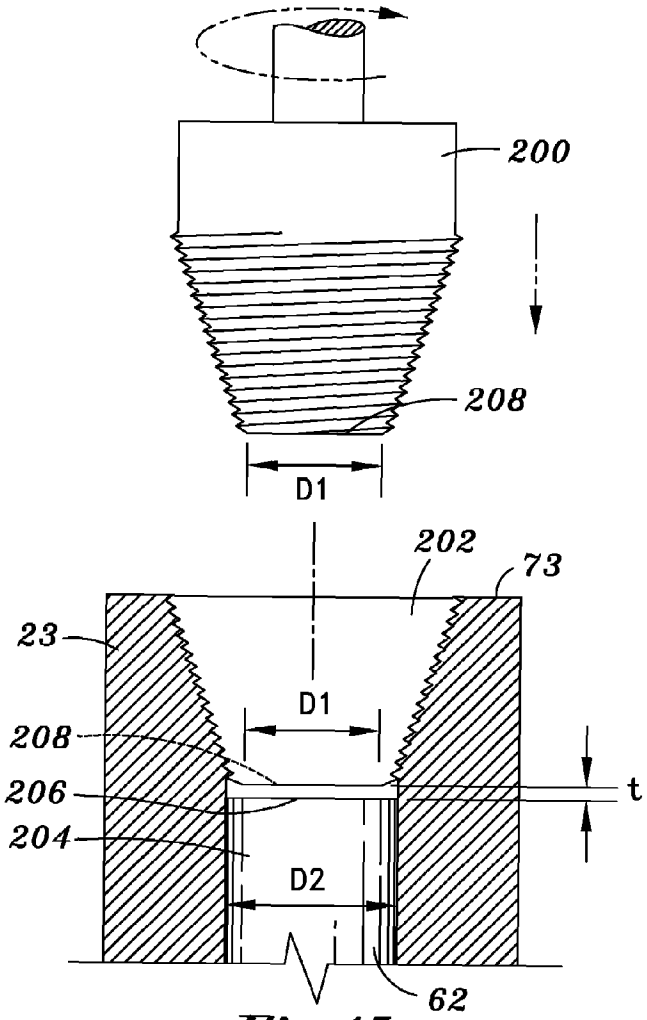
FIG. 15 is a schematic view of a U.S. standard pipe thread cutting die, shown in conjunction with an internal bore cut by the die.

In order to achieve the configuration as described above, there is first exemplified with reference to FIGS. 15-16 a method for preparing a connection arrangement according to the above described principles. Using a U.S. standard pipe thread cutting die 200, an internal threaded bore 202 is cut into an air connector element 23 of the housing. (The provisions of ANSI B2-1968 set forth the dimensions of a U.S. standard pipe thread, and are incorporated herein by reference.) The advance tip 208 of the die 200 has a diameter D1 and the die 200 has a slightly conical taper. However, the threaded bore 202 is cut into the connector element to axially intersect with a cylindrical bore portion 204 (preferably smooth) that has a diameter D2. The diameter D2 is sized to be as large or slightly larger than D1, in no event smaller than D1, and is also sized to receive the valve 62 that controls air flow to the chamber 52. The bore 202 is cut to a precise depth, in which the die 200 stops cutting when the advance tip 208 is a distance "t" (as shown in FIG. 15) short of contacting the base 206 of the valve 62 (or, stated otherwise, short of reaching the point where the base 206 of the valve 62 would be in its final operating position if the valve were in the cylindrical bore 204 during the cutting process.) In a preferred embodiment, the distance "t" is between 0.8 and 1.2 times the gauge of a thread on the cutting die, most preferably, about one times the gauge.

Turning now to FIG. 16, there is shown how an inlet piece 76 having been cut externally to the same standard pipe thread dimensions as the cutting die 200, is inserted into the bore 202 prepared as described above. It will be appreciated that, at a standard torque, the inlet piece 76 would stop with its advance tip 210 a distance "t" from the base 206 of the valve 62. However, because the diameter D2 of the cylindrical bore portion 204 is not smaller than the diameter D1 of the advance tip 208 of the cutting die (and therefore also not smaller than the diameter of the advance tip 210 of the inlet piece), the inlet piece 76 may be turned deeper into the bore 202 without damage to either internal or external threads, until the advance tip 210 comes into contact with the base 206 of the valve 62. Under these conditions, it has been found, the strain in the threads of the inlet 76 and the threaded bore 202 exceeds the standard design strain for a pipe thread, yet is sufficient to provide both the required seal and retention functions of the connection, without unacceptable injury to the threads.

In this way, a novel connection is formed without relying on an O-ring to form a seal, and thus a significant reduction in size of the squeezer components can be additionally achieved beyond those already described.

In yet a further aspect, arising from the miniaturization of the squeezer of the present invention described herein, it is possible to manufacture a rivet squeezer capable of delivering some tons of squeezing force between the external arms of the jaws, while at the same time making the squeezer to weigh no more than 1.0 kilograms and extend no more than 19 cm from the proximal end (excluding the air inlet piece) to the distal tips of the jaws. This is a useful weight and length reduction in light of presently available portable rivet squeezers that commonly may weigh about 1.7 kilograms and may be about 24 cm in length.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

I claim:

1. A rivet squeezer comprising:

a housing having a first cavity in an internal wall;

a first jaw positioned partially within the housing, the first jaw having a second cavity in an external wall;

a second jaw positioned partially within the housing;

a wedge operable between a starting position and an ending position and adapted to be pneumatically forced from the starting position, thence between internal ends of the first and second jaws, to the ending position, whereby the internal ends are forced apart, and external ends of the jaws are forced together; and a return spring for returning the wedge from the ending position to the starting position;

wherein the return spring is diametrically positioned partially within the first cavity in the housing, and partially within the second cavity in the first jaw.

2. The rivet squeezer of claim 1, wherein the first jaw is fixed to the housing, and the second jaw is pivotable about a pivot point.

3. The rivet squeezer of claim 1, wherein the wedge moves in a direction of travel, and wherein the second cavity in the first jaw is elongate and parallel to the direction of travel.

4. The rivet squeezer of claim 1, wherein the wedge is activated by a piston, and wherein the spring is positioned, at a first end of the spring, against the piston.

5. The rivet squeezer of claim 1, wherein the spring is positioned, at a second end of the spring, against a terminal point of the first cavity in the housing, and also against a terminal point of the second cavity in the first jaw.

6. The rivet squeezer of claim 1, wherein a roller is pinned to the internal end of the first jaw for contacting the wedge as the wedge moves from starting to ending position.

7. The rivet squeezer of claim 1, wherein a roller is pinned to the internal end of the second jaw for contacting the wedge as the wedge moves from starting to ending position.

8. The rivet squeezer of claim 1, wherein the rivet squeezer weighs less than 1 kilogram.

9. The rivet squeezer of claim 1, wherein the length of the rivet squeezer is less than 19 cm.

10. The rivet squeezer of claim 1, wherein the wedge is operable between a starting position and an ending position and is adapted to be pneumatically forced from the starting position, thence between internal ends of the first and second jaws, to the ending position, whereby the internal ends are forced apart, and external ends of the jaws are forced together;

wherein the wedge has:

a first surface for engaging the first jaw, the first surface being flat; and a second surface for engaging the second jaw, the second surface including:

a first curve with a radius between 0.85 inches and 0.95 inches and a center point in a range between (−0.35 inches, 0.60 inches) and (−0.45 inches, 0.70 inches);

a second curve with a radius between 5.0 inches and 6.0 inches and a center point in a range between (−4.5 inches, 0.0 inches) and (−5.5 inches, 0.0 inches).

11. A rivet squeezer comprising:

a housing;

a first jaw positioned partially within the housing, the first jaw being fixed to the housing;

a second jaw positioned partially within the housing, the second jaw being pivotable about a pivot point; and a wedge operable between a starting position and an ending position and adapted to be pneumatically forced from the starting position, thence between internal ends of the first and second jaws, to the ending position, whereby the internal ends are forced apart, and external ends of the jaws are forced together;

wherein the wedge has:

a first surface for engaging the first jaw, the first surface being flat; and a second surface for engaging the second jaw, the second surface including:

a first curve with a radius between 0.85 inches and 0.95 inches and a center point in a range between (−0.35 inches, 0.60 inches) and (−0.45 inches, 0.70 inches);

a second curve with a radius between 5.0 inches and 6.0 inches and a center point in a range between (−4.5 inches, 0.0 inches) and (−5.5 inches, 0.0 inches).

12. The rivet squeezer of claim 11, wherein the wedge has a height between 1.4 inches and 1.6 inches and a width between 0.5 inches and 0.6 inches.

13. The rivet squeezer of claim 11, wherein the first and second curves join at a point that produces a continuous surface.

14. The rivet squeezer of claim 11, wherein the squeezer further comprises:

an internal threaded bore in the housing for receiving an air supply, the threaded bore having a thread gauge and configured to have dimensions of a U.S. standard pipe thread having a conical taper, the threaded bore coinciding with a cylindrical bore having a first diameter and holding a valve; and an inlet piece for supplying air to the squeezer, the inlet piece having external threads of the same U.S. standard pipe thread as the threaded bore, the inlet piece having a terminal end with a second diameter not greater than the first diameter, wherein the length of the valve is such that, when the inlet piece is inserted into the bore to a standard torque, the terminal end is a distance "t" from an end of the valve, "t" being between 0.8 and 1.2 times the gauge of the bore thread; and further wherein the inlet piece is torqued into the bore beyond standard torque so that the terminal end of the inlet piece is in contact with the end of the valve, and no O-ring is used to seal the inlet piece to the bore.

15. The rivet squeezer of claim 11, wherein the rivet squeezer weighs less than 1 kilogram.

16. The rivet squeezer of claim 11, wherein the length of the rivet squeezer is less than 19 cm.

17. A rivet squeezer comprising:

a housing;

a first jaw partially included within the housing;

a second jaw partially included within the housing;

a wedge operable between a starting position and an ending position and adapted to be pneumatically forced from the starting position, thence between internal ends of the first and second jaws, to the ending position, whereby the internal ends are forced apart, and external ends of the jaws are forced together; and an internal threaded bore in the housing for receiving an air supply, the threaded bore having a thread gauge and configured to have dimensions of a U.S. standard pipe thread having a conical taper, the threaded bore coinciding with a cylindrical bore having a first diameter and holding a valve; and an inlet piece for supplying air to the squeezer, the inlet piece having external threads of the same U.S. standard pipe thread as the threaded bore, the inlet piece having a terminal end with a second diameter not greater than the first diameter, wherein the length of the valve is such that, when the inlet piece is inserted into the bore to a standard torque, the terminal end is a distance "t" from an end of the valve, "t" being between 0.8 and 1.2 times the gauge of the bore thread; and further wherein the inlet piece is torqued into the bore beyond standard torque so that the terminal end of the inlet piece is in contact with the end of the valve, and no O-ring is used to seal the inlet piece to the bore.

18. The rivet squeezer of claim 17, wherein the housing includes a first cavity in an internal wall, and the first jaw includes a second cavity in an external wall, the rivet squeezer further including a return spring for returning the wedge from the ending position to the starting position, wherein the return spring is positioned diametrically partially within the first cavity in the housing, and diametrically partially within the second cavity in the first jaw.

19. The rivet squeezer of claim 17, wherein the rivet squeezer weighs less than 1.0 kilogram.

20. The rivet squeezer of claim 17, wherein the length of the rivet squeezer is less than 19 cm.

* * * * *